US007888572B2

(12) United States Patent
Rosenberg et al.

(10) Patent No.: US 7,888,572 B2
(45) Date of Patent: Feb. 15, 2011

(54) GUITAR STRAP LOCK

(75) Inventors: James Richard Rosenberg, Santa Cruz, CA (US); Richard Taylor Akers, Nashville, TN (US)

(73) Assignee: Gibson Guitar Corp., Nashville, TN (US)

( * ) Notice: Subject to any disclaimer, the term of this patent is extended or adjusted under 35 U.S.C. 154(b) by 0 days.

(21) Appl. No.: 11/620,200

(22) Filed: Jan. 5, 2007

(65) Prior Publication Data

US 2008/0163738 A1 Jul. 10, 2008

(51) Int. Cl.
*G10D 3/00* (2006.01)

(52) U.S. Cl. ..... 84/327; 84/329

(58) Field of Classification Search ..... 84/327, 84/329

See application file for complete search history.

(56) References Cited

U.S. PATENT DOCUMENTS

| | | | | | |
|---|---|---|---|---|---|
| 689,991 | A * | 12/1901 | Rubin | 24/645 |
| 3,631,572 | A * | 1/1972 | Lange | 24/665 |
| 4,144,794 | A * | 3/1979 | Silverman et al. | 84/327 |
| 4,274,181 | A * | 6/1981 | Schaller | 24/656 |
| 4,291,822 | A * | 9/1981 | Simonds | 224/257 |
| 4,357,063 | A * | 11/1982 | Gray | 439/327 |
| 4,592,266 | A * | 6/1986 | Daugherty | 84/327 |
| D293,687 | S * | 1/1988 | Nichols | D17/20 |
| 4,843,943 | A * | 7/1989 | Hoshino | 84/327 |
| 4,901,900 | A * | 2/1990 | Goto | 224/257 |
| 4,953,267 | A * | 9/1990 | Marino et al. | 24/682.1 |
| 4,993,127 | A * | 2/1991 | Mechem et al. | 24/701 |
| 6,032,339 | A * | 3/2000 | D'Addario | 24/649 |
| 6,080,922 | A * | 6/2000 | Dimbath | 84/327 |
| 6,169,238 | B1 * | 1/2001 | Bolo, III | 84/453 |
| D466,546 | S * | 12/2002 | Warden | D17/20 |
| 7,045,694 | B2 * | 5/2006 | Yasunori | 84/329 |
| 7,166,789 | B2 * | 1/2007 | Warden | 84/327 |
| 7,256,337 | B1 * | 8/2007 | Walker | 84/327 |
| 7,459,618 | B2 * | 12/2008 | Kim et al. | 84/299 |
| 7,562,422 | B2 * | 7/2009 | D'Addario et al. | 24/701 |
| 7,669,299 | B2 * | 3/2010 | McAnelly | 24/658 |
| 7,818,851 | B2 * | 10/2010 | Perrotta | 24/701 |
| 2002/0000153 | A1 * | 1/2002 | Doiron | 84/327 |
| 2008/0163738 | A1 * | 7/2008 | Rosenberg et al. | 84/421 |
| 2008/0202313 | A1 * | 8/2008 | Ruel | 84/327 |
| 2010/0107850 | A1 * | 5/2010 | Furuta | 84/327 |
| 2010/0126329 | A1 * | 5/2010 | Bowen | 84/327 |

OTHER PUBLICATIONS

Exhibit A: Website printout of Dunlop Straplok Ergo Lok Strap (undated but admitted to be prior art prior to Jan. 4, 2006).
Exhibit B: Dunlop Straplok Dual Design (undated but admitted to be prior art prior to Jan. 4, 2006).

* cited by examiner

*Primary Examiner*—Elvin G Enad
*Assistant Examiner*—Robert W Horn
(74) *Attorney, Agent, or Firm*—Bates & Bates, LLC; Andrea E. Bates

(57) ABSTRACT

This invention is a guitar strap lock apparatus for connection to a guitar strap button on a guitar. The apparatus has a lock body defining a cavity with a resilient retainer latch attached to the lock body. The resilient retainer latch partially protrudes over a side opening in the lock body so that a securing portion of the button is secured within the latch when the button is received in the cavity.

11 Claims, 4 Drawing Sheets

GUITAR STRAP LOCK

BACKGROUND OF THE INVENTION

The present invention relates generally to mechanisms for attaching a strap to a guitar.

Guitar players require an apparatus for supporting a guitar around the guitar player's neck or other body appendage. To accomplish this goal, guitar buttons are often attached to the body of the guitar. A guitar strap engages these buttons utilizing a pair of coupling apparatuses on the ends of the strap. Unfortunately, these mechanisms are often complex and cumbersome. Often, the guitar player must manipulate unnecessarily complicated coupling mechanisms to secure and unsecure the coupling apparatuses from the button. Thus, the prior art coupling apparatuses often require the user to pull a lever or a manually operated knob in a direction different from the direction required to engage the button on the apparatus.

For example, U.S. Pat. No. 4,901,900 discloses an engaging member with a chamber for inserting a guitar button. The engaging member is composed of two engaging pieces. The engaging pieces are connected to a shaft which contains a pair of pins. By rotating the shaft, the engaging pins separate the engaging pieces thereby permitting the button to be released from the chamber. Thus, with this design, the operator must rotate a shaft and at the same time remove the button from the chamber. The user thus must provide a movement for the mechanism which is inapposite to the movement for removing the button.

Another example is found in U.S. Pat. No. 4,274,181. This patent reveals a mechanism with a catch having a chamber for receiving a guitar button. The guitar button has a groove at the top for receiving the lower part of a plunger in the catch. In order to remove the button from the catch, the guitar player must pull the plunger in a vertical direction thereby removing the lower part of the plunger from the groove in the button. The user then slides the button out of the chamber. As can be seen, a user must provide a vertical motion on the plunger in order to remove the bottom of the plunger from the button and provide a horizontal movement in order to remove the button from the catch's chamber. These prior art devices require the user to provide a motion for the securing mechanism, and a motion for removing the button from a chamber.

BRIEF SUMMARY OF THE INVENTION

What is needed is a guitar strap lock apparatus which does not require complicated mechanisms for securing and removing the button from a chamber. To accomplish this, a lock body is attached to the strap and has a cavity defined therein for receiving the strap button on the guitar. The strap button is received by sliding the button into the cavity. To secure the strap button to the lock body, the lock body comes equipped with a resilient latch. This latch defines a resilient latch opening for receiving the button when the button is slid into the cavity. Once the button is received in the latch, the button is removed from the cavity by again forcing the button through the resilient latch opening. Because of the resiliency of the resilient opening, all that is required to remove the button is a sliding motion out of the cavity. This guitar strap lock apparatus therefore does not require burdensome mechanism movements by the guitar player to remove the guitar button from the strap lock apparatus.

Accordingly, one object of the present invention is to provide a simple mechanism for securing a guitar button.

Another object of the present invention is to provide a guitar strap lock apparatus which removes the strap button from the apparatus in a single motion.

Still another object of the present invention is to secure the guitar button within a chamber defined by the guitar strap lock apparatus.

DETAILED DESCRIPTION OF THE INVENTION

Figure 1:
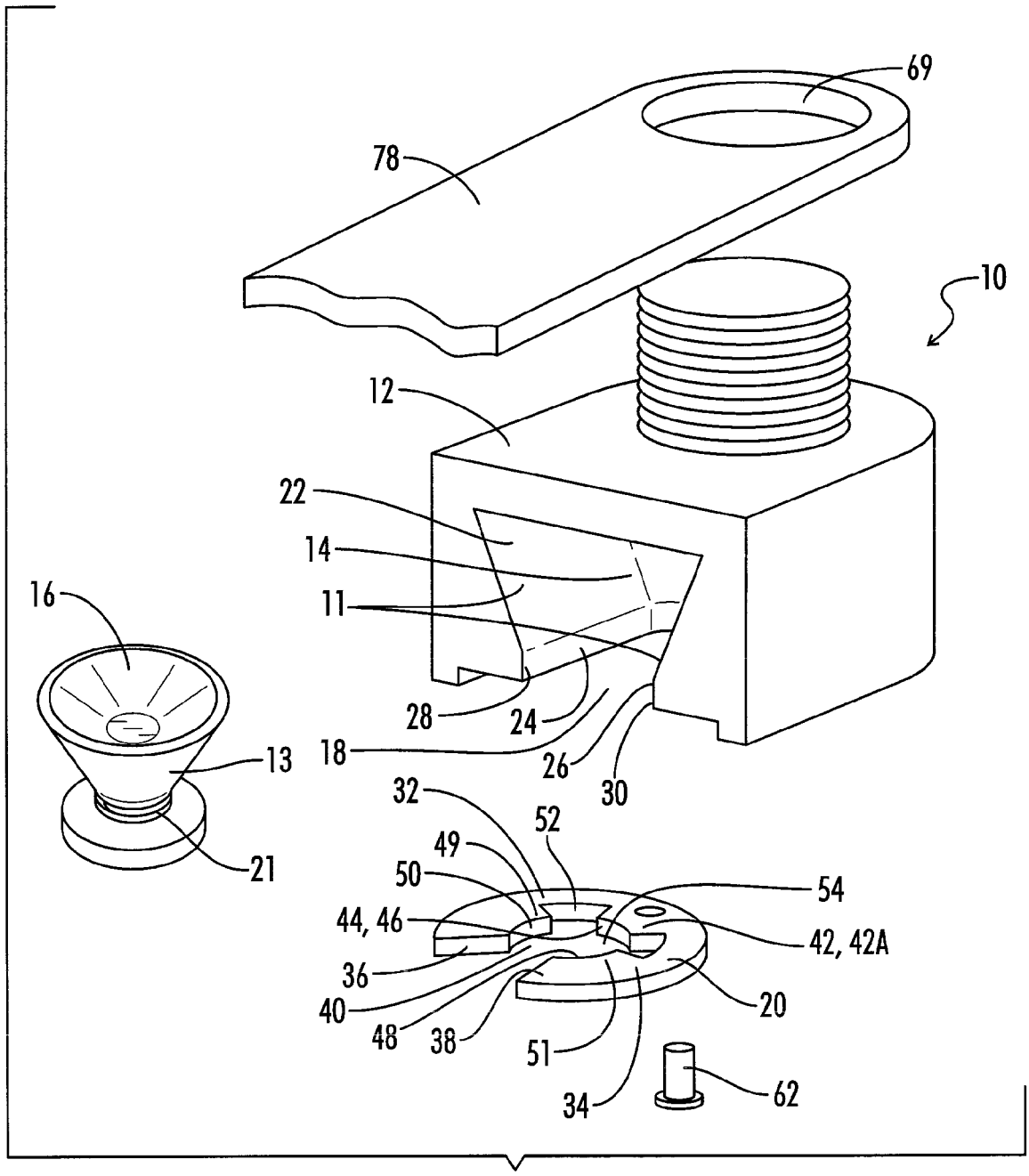
FIG. 1 is an exploded perspective view of a first embodiment of the strap lock apparatus.
Figure 2:
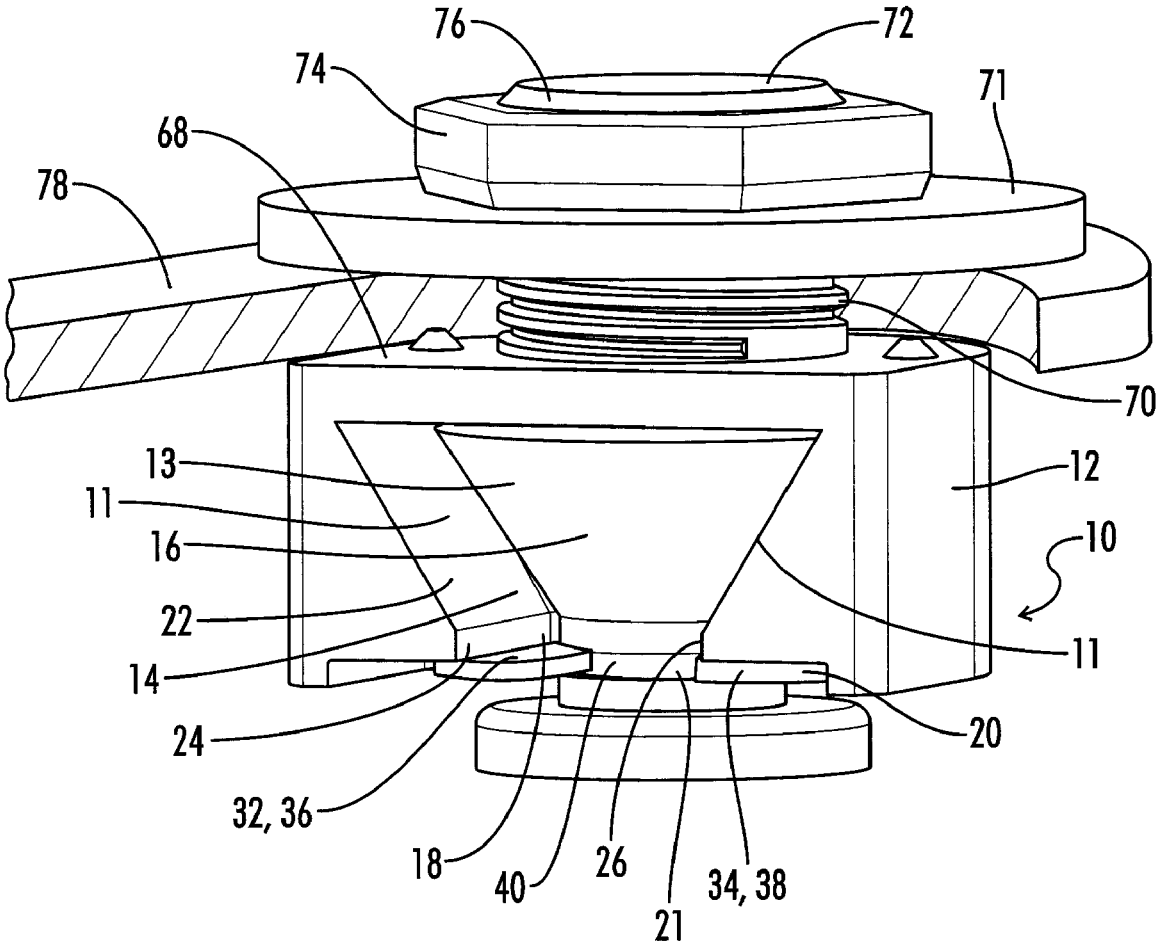
FIG. 2 is a front perspective view of the guitar strap lock apparatus of FIG. 1 having a guitar strap button inserted into the cavity.

Referring now to FIGS. 1 and 2, a guitar strap lock apparatus 10 for attaching a guitar strap 78 to a strap button 16 on a guitar is shown. The guitar strap lock apparatus 10 has a lock body 12 which defines a cavity 14 for receiving the strap button 16. The lock body 12 of the guitar strap lock apparatus 10 maybe of any shape whether utilitarian, aesthetic, or practical. The only requirement is that the cavity 14 be shaped to receive the strap button 16 in a sliding motion. For example, the cavity 14 in the figures has a cross section with tapered side walls 11 for closely receiving a conically shaped head portion 13 of the button 16.

When the strap button 16 is received by the cavity 14, a latch 20 secures a securing portion 21 or neck 21 of the strap button 16 to the lock body 12. Once inserted into the latch, the securing portion 21 extends from the side opening 18 when the strap button 16 is received by the cavity 14. The latch 20 defines a resilient latch opening 40 which is expandable to receive the securing portion 21 of the button 16. In this manner, the strap button 16 is maintained within the cavity 14 until desired removal by the guitar player.

In the embodiment shown in FIG. 1 and FIG. 2, the cavity 14 has an end opening 22 and a side opening 18. The side opening 18 has a first sliding edge 24 and a second sliding edge 26 on opposite sides of the opening 18. Each edge, 24, 26 has an entrance end 28, 30 located at the end opening 22. These entrance ends 28, 30 define an entrance width for receiving the sliding portion of the button 16.

In addition, the resilient retainer latch has a first resilient arcuate arm 32 and a second resilient arcuate arm 34 for securing the button 16 to the lock body 12. These arcuate arms 32, 34 have arm ends 36, 38 which protrude over the sliding edges 24, 26 and define a resilient latch opening 40 with a latch opening width less than the entrance width. By protruding partially over the side opening 18, the button 16 which slides on sliding edges 24, 26 must be forced through the resilient latch opening 40.

To secure the button 16, the button 16 is firmly engaged within a securement area 54 in the latch 20. The bounds of the securement area 54 are defined by securement edges 46, 48,50 which extend from the inner perimeter 52 of the latch 20. These securement edges 46, 48, and 50 fit tightly around the button 16 when the button 16 is inserted within the latch 20. The button 16 is thereby secured within the securement area 54 utilizing edges 46, 48, and 50.

These edges may be provided on a securement member 42. The securement member 42 has a securement end 44 with the first securement edge 46 oriented toward the resilient latch opening. Securement edge 46 therefore defines one of the bounds of the securement area 54. In this example, the securement member 42 is a tab 42A attached to the inner perimeter of the latch. As is shown in FIG. 1, the latch 20 maybe a C-ring, which is expandable to receive the securing portion 21 of the button 16 within the latch 20 when the strap button 16 is received in the cavity. The tab 42A is found between arm ends 32, 34 so that the tab 42A places the securing portion 21 in a location offset from the interior perimeter 52 of the C-ring. Arm ends 36, 38 may also have tabs 49 and 51 so that the securement area 54 is offset from the arm ends 36, 38. In the preferred embodiment, the length of the tabs 42, 49, 51 is such that the securement area 54 is centrally located within the C-ring. The particular ring illustrated, with tabs 42, 49 and 51, is sometimes referred to as a Type E Retaining Ring.

The latch may be made of any suitable resilient material and may be attached to the lock body 12 by any convenient device. In the preferred embodiment however, the latch comprises carbon spring steel and a securing pin 62 attaches the latch 20 to the lock body 12. Other suitable resilient materials for the latch include hard nylon and ABS polymers. The latch 20 may also be welded, attached with a screw, clipped, or attached by any other similar device to the lock body 12.

Referring now specifically to FIG. 2, the lock body 12 is shown attached to a guitar strap 78. The lock body 12 has a strap fixing side 68 for fixing the lock body 12 to the strap 78. This strap fixing side 68 has a threaded post 70 which extends from the strap fixing side 68 with an end 72 distal to the lock body 10. A strap aperture 69 (shown in FIG. 1) receives the post 70 whereupon a fastener 74 defining a fastener aperture 76 threads into the threaded post 70. This is the preferred manner of attaching the strap 78 to the lock body 12. Furthermore, a washer 71 may be placed between the fastener 74 and the strap 78 to provide a more secure connection.

The lock body 12 thus fastens the strap 78 to the button 16. In order to accomplish this, the securing portion 21 has a width greater than the width of the resilient opening 40. The latch 20 thus resiliently expands to receive the securing portion 21 when the button 16 is slid into the cavity 14. Once the button 16 is inserted, the button 16 is removed by forcing the button 16 past the resilient opening 40. Thus, the resiliency of the latch 20 is such that a minimum releasing force must be applied on the button 20 to force the button out of the resilient latch 20. Consequently, the guitar strap lock apparatus 10 provides a simple and straightforward mechanism for inserting and removing the button 16 from the lock body 12 with a simple sliding motion.

Figure 3:
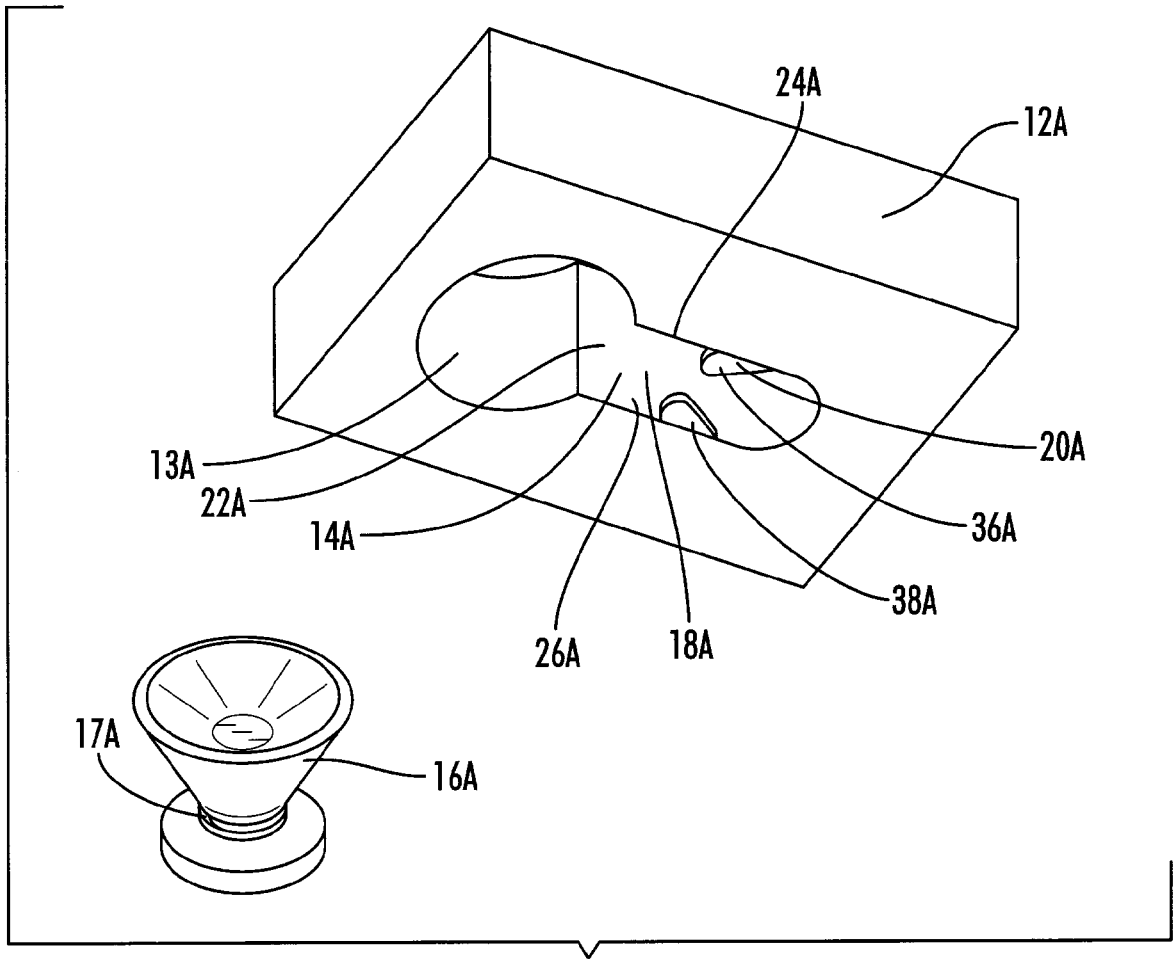
FIG. 3 is a bottom perspective view of a second embodiment of the guitar strap lock apparatus.

Referring to FIG. 3, a second embodiment of the invention is shown. In this embodiment, the cavity 14A is extended and closed. In order to gain access to the end opening 22A of the cavity 14A, an insertion aperture 13A is provided on the bottom of the lock body 12A. Once the inserted into the lock body 12A, the button 16A maybe slid along the sliding edges 24A, 26A into the cavity 14A through the end opening 22A. Resilient retainer latch 20A has arm ends 36A, 38A which partially protrude over the side opening 18A. As in the previous embodiment, the neck 17A of the button 16A is slid into the resilient retainer latch 20A to secure the button 16A to the lock body 12A.

Figure 4:
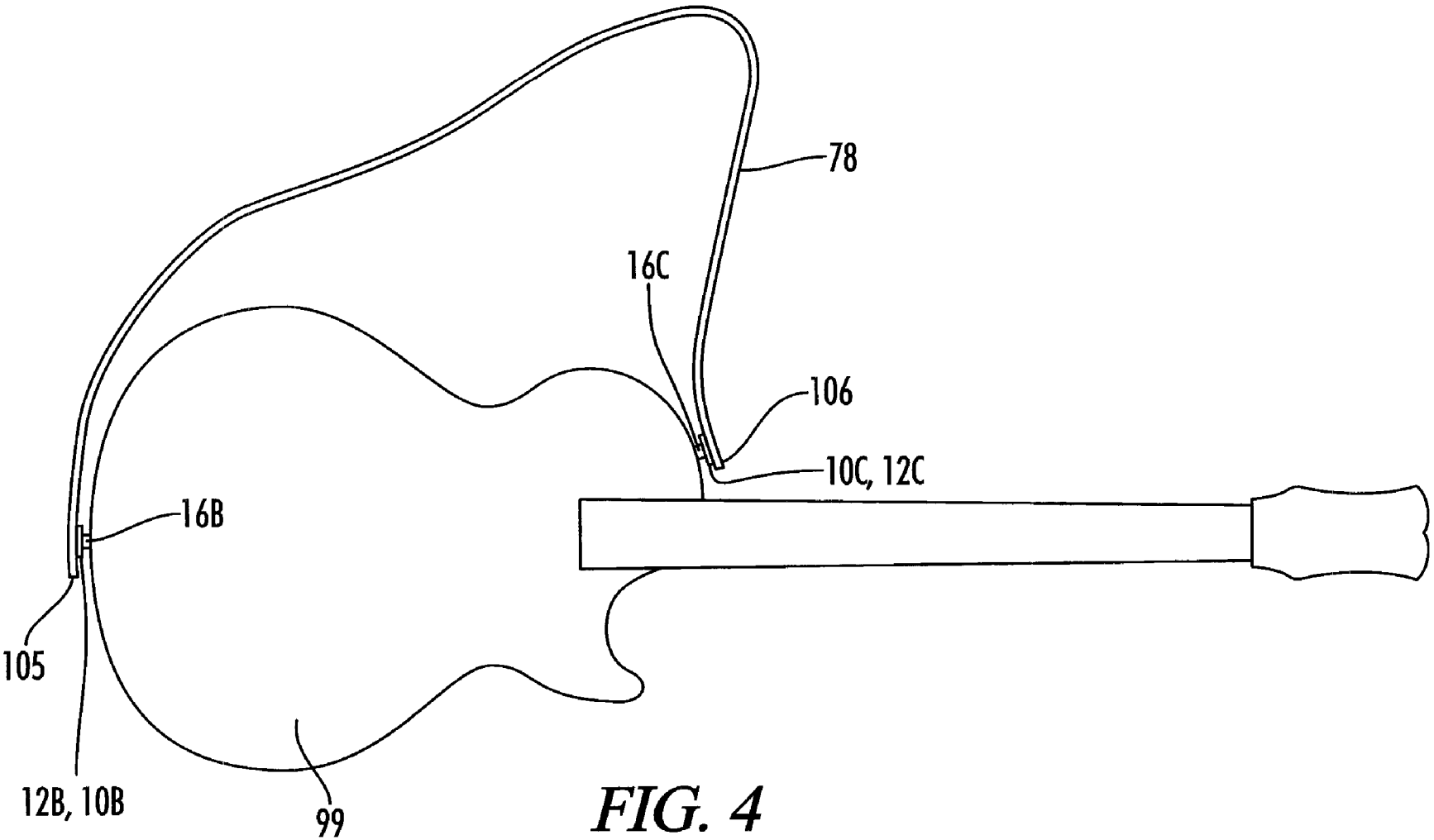
FIG. 4 is a front view of a guitar having buttons engaging a strap with the guitar strap lock apparatuses.

Finally, referring to FIG. 4, guitar strap lock apparatuses 10B, 10C are shown attached to the guitar 99. By utilizing the guitar strap lock apparatuses 10B, 10C, the guitar player may use the strap 78 to support the guitar 99 with his body. The strap 78 has strap ends 105, 106 which are connected to strap lock apparatuses 10B and 10C. Buttons 16B, 16C are attached at different locations on the guitar 99 and insert into the lock bodies 12B, 12C. Latches on the lock bodies 12B, 12C secure the buttons 16B, 16C within the lock bodies 12B, 12C thereby providing a secure connection between the guitar 99 and the strap 78.

Thus, although there have been described particular embodiments of the present invention of a new and useful Strap Lock, it is not intended that such references be construed as limitations upon the scope of this invention except as set forth in the following claims.

What is claimed is:

1. A musical instrument strap lock apparatus for attaching a strap to a strap button on a musical instrument, comprising:

a lock body comprising at least two connected side walls, wherein the connected side walls define a cavity, wherein the cavity has an insertion aperture and a side opening;

a resilient retainer latch integral to the lock body, wherein the resilient retainer latch comprises at least one securement edge, wherein the at least one securement edge defines a securement area, wherein the securement area has a resilient latch opening; and a strap fixing apparatus connected with the lock body, wherein the strap fixing apparatus detachably connects a strap to the lock body, wherein the strap is attached with a musical instrument by first receiving a strap button in the insertion aperture and then securely receiving the strap button in the cavity and the securement area by sliding the strap button through the side opening and the resilient latch opening in a direction radial to the strap button axis; wherein the at least two connected side walls comprise a first sliding edge and a second sliding edge, wherein each sliding edge begins at the insertion aperture, further wherein each sliding edge is opposite of each other and a distance between the first sliding edge and the second sliding edge at the insertion aperture defines a cavity entrance width; yet further wherein the resilient retainer latch comprises a first resilient arcuate arm and a second resilient arcuate arm, each arcuate arm having an arm end protruding partially over one of the sliding edges, wherein the arcuate arm ends define a width of the resilient latch opening, and further wherein the resilient latch opening width is less than the cavity entrance width.

2. The apparatus of claim 1 wherein the resilient retainer latch further comprises an inner perimeter edge, wherein the securement edge comprises a radially extending tab protruding from the inner perimeter edge, further wherein the tab places a neck of the strap button in a location offset from the inner perimeter edge when the neck is received by the resilient retainer latch.

3. The apparatus of claim 2 wherein the location offset from the inner perimeter edge is centrally located within the resilient retainer latch.

4. A musical instrument strap lock apparatus for attaching a strap to a strap button on a musical instrument, comprising:

a lock body comprising at least two connected side walls, wherein the connected side walls define a cavity, wherein the cavity has an insertion aperture and a side opening;

a resilient retainer latch integral to the lock body, wherein the resilient retainer latch comprises at least one securement edge, wherein the at least one securement edge defines a securement area, wherein the securement area has a resilient latch opening;

a strap fixing apparatus connected with the lock body, wherein the strap fixing apparatus detachably connects a strap to the lock body, wherein the strap is attached with a musical instrument by first receiving a strap button in the insertion aperture and then securely receiving the strap button in the cavity and the securement area by sliding the strap button through the side opening and the resilient latch opening in a direction radial to the strap button axis; and a securing pin, wherein the securing pin attaches the resilient retainer latch with the lock body.

5. The apparatus of claim 4 wherein the lock body and resilient retainer latch are a single component.

6. The apparatus of claim 4 wherein the resilient retainer latch is a Type E retaining ring.

7. The apparatus of claim 4 wherein the resilient retainer latch is carbon spring steel.

8. The apparatus of claim 4 wherein the strap fixing apparatus is connected with a strap fixing side.

9. The apparatus of claim 8 wherein the strap fixing apparatus comprises a threaded post extending from the strap fixing side, the threaded post having an end distal to the lock body; and a fastener defining an aperture, the aperture threading onto the threaded post for fixing the strap with the lock body.

10. A method of attaching a strap with a musical instrument body comprising:

attaching a strap semi-permanently to a strap lock apparatus;

inserting a strap button into an insertion aperture on the strap lock apparatus;

securing the strap button by sliding the strap button in a direction radial to the strap button axis through a side opening and a resilient retainer latch on the strap lock apparatus, wherein the insertion aperture is defined by a lock body comprising at least two connected side walls, wherein the at least two connected side walls define a cavity, further wherein the side opening is defined by a lock body comprising at least two connected side walls, wherein the at least two connected side walls define a cavity, yet further wherein the strap is semi-permanently attached with the strap lock apparatus by a strap fixing apparatus, wherein the strap fixing apparatus comprises a threaded post extending from a strap fixing side of the strap lock apparatus, the threaded post having an end distal to the strap lock apparatus; and a fastener defining an aperture, the aperture threading onto the threaded post for fixing the strap to the strap lock apparatus.

11. The method of claim 10 wherein the strap is attached with a musical instrument body in at least two locations.

* * * * *